US007426838B1

(12) United States Patent
Shapiro et al.

(10) Patent No.: US 7,426,838 B1
(45) Date of Patent: Sep. 23, 2008

(54) ICEMAKER ASSEMBLY

(75) Inventors: Andrew Philip Shapiro, Niskayuna, NY (US); Jerome Johnson Tiemann, Schenectady, NY (US); Walter Whipple, Amsterdam, NY (US); Timothy Scott Shaffer, LaGrange, KY (US); William Merritt Nall, Jr., Louisville, KY (US); Eayre Bruce Voorhees, Sloansville, NY (US); Steven Paraszczak, Clifton Park, NY (US)

(73) Assignee: General Electric Company, Schenectady, NY (US)

( * ) Notice: Subject to any disclaimer, the term of this patent is extended or adjusted under 35 U.S.C. 154(b) by 1826 days.

(21) Appl. No.: 09/617,935

(22) Filed: Aug. 17, 2000

Related U.S. Application Data

(60) Provisional application No. 60/158,636, filed on Oct. 8, 1999, provisional application No. 60/158,634, filed on Oct. 8, 1999, provisional application No. 60/158,633, filed on Oct. 8, 1999, provisional application No. 60/158,631, filed on Oct. 8, 1999, provisional application No. 60/158,630, filed on Oct. 8, 1999, provisional application No. 60/158,629, filed on Oct. 8, 1999.

(51) Int. Cl.
*F25C 1/12* (2006.01)

(52) U.S. Cl. ..... 62/353

(58) Field of Classification Search ..... 62/353
See application file for complete search history.

(56) References Cited

U.S. PATENT DOCUMENTS 2,381,069 A * 8/1945 Lutes et al. ..... 62/353
2,487,408 A 11/1949 Askin
2,767,557 A 10/1956 Hubacker
2,891,387 A 6/1959 Cocanour
2,914,218 A 11/1959 Korodi
3,146,601 A 9/1964 Gould
3,525,232 A 8/1970 Toma
3,537,618 A 11/1970 Alvarez
3,545,217 A 12/1970 Linstrombereg
3,580,007 A 5/1971 Bauerlein
3,612,848 A 10/1971 Koch et al.
3,621,668 A 11/1971 Swerbinsky
3,635,043 A 1/1972 Sterling
3,724,804 A 4/1973 Campbell et al.
3,727,426 A 4/1973 Kesling
3,775,992 A 12/1973 Bright (Continued)

FOREIGN PATENT DOCUMENTS

FR 790434 11/1935

(Continued)

*Primary Examiner*—William E. Tapolcai
(74) *Attorney, Agent, or Firm*—Patrick K. Patnode; Christian Cabou

(57) ABSTRACT

An icemaker assembly is disposed within a refrigerator having a freezer compartment, a fresh food compartment and respective freezer and fresh food door assemblies. The icemaker assembly comprises a conveyor assembly positioned within the freezer compartment having a flexible conveyor belt with a multiplicity of individual ice cube molds for creation of individual ice cubes. An ice cube storage bin is positioned below the conveyor assembly for storing the ice cubes and a fullness sensor is positioned for determining the fill level of ice cubes within the ice cube storage bin.

26 Claims, 8 Drawing Sheets

U.S. PATENT DOCUMENTS

| | | | |
|---|---|---|---|
| 3,788,089 | A | 1/1974 | Graves |
| 3,791,166 | A | 2/1974 | Maleck |
| 3,825,158 | A | 7/1974 | Morris, Jr. |
| 3,878,693 | A | 4/1975 | Prada |
| 3,892,105 | A | 7/1975 | Bernard |
| 3,908,394 | A | 9/1975 | Jacobus |
| 3,911,692 | A | 10/1975 | Maxwell et al. |
| 3,926,007 | A | 12/1975 | Braden et al. |
| 3,952,539 | A | 4/1976 | Hanson et al. |
| 3,982,406 | A | 9/1976 | Hanson et al. |
| 3,984,996 | A | 10/1976 | Bright |
| 4,003,214 | A | 1/1977 | Schumacher |
| 4,100,761 | A | 7/1978 | Linstromberg |
| 4,129,015 | A | 12/1978 | Morris, Jr. |
| 4,191,025 | A | 3/1980 | Webb |
| 4,227,383 | A | 10/1980 | Horvay |
| 4,269,039 | A | 5/1981 | Baker |
| 4,285,212 | A | 8/1981 | Prada |
| 4,292,816 | A | 10/1981 | Gartzke |
| 4,333,588 | A | 6/1982 | Schreck et al. |
| 4,341,087 | A | 7/1982 | Van Steenburgh |
| 4,474,023 | A | 10/1984 | Mullins, Jr. |
| 4,719,765 | A | 1/1988 | Hooper et al. |
| 4,790,346 | A | 12/1988 | Kolze et al. |
| 4,842,167 | A | 6/1989 | Fornasari |
| 4,852,359 | A | 8/1989 | Mazzittu |
| 4,872,318 | A | 10/1989 | Klemmensen |
| 4,886,239 | A | 12/1989 | Stimmel |
| 4,942,742 | A | 7/1990 | Burruel |
| 4,949,229 | A | 8/1990 | Bassi |
| 4,972,999 | A | 11/1990 | Grace |
| 5,014,523 | A | 5/1991 | Kohl |
| 5,034,861 | A | 7/1991 | Skienak et al. |
| 5,056,688 | A | 10/1991 | Goetz et al. |
| 5,077,985 | A | 1/1992 | Buchser et al. |
| 5,125,242 | A | 6/1992 | von Blanquet |
| 5,127,236 | A | 7/1992 | von Blanquet |
| 5,140,831 | A | 8/1992 | Kohl et al. |
| 5,177,976 | A | 1/1993 | Suweon et al. |
| 5,187,948 | A | 2/1993 | Frohbieter |
| 5,283,721 | A | 2/1994 | Powell |
| 5,297,394 | A | 3/1994 | Frohbieter et al. |
| 5,405,052 | A | 4/1995 | Sawyer |
| 5,408,392 | A | 4/1995 | Hughes |
| 5,408,844 | A | 4/1995 | Stokes |
| 5,425,248 | A | 6/1995 | Trantina |
| 5,488,942 | A | 2/1996 | Maughan |
| 5,555,743 | A | 9/1996 | Hatanaka |
| 5,603,230 | A | 2/1997 | Tsai |
| 5,722,244 | A | 3/1998 | Shelton |
| 5,787,724 | A | 8/1998 | Pohl et al. |
| 5,873,646 | A | 2/1999 | Fjaestad et al. |
| 5,980,058 | A | 11/1999 | Guess et al. |
| 6,050,097 | A | 4/2000 | Nelson et al. |
| 6,058,731 | A | 5/2000 | Byczynski et al. |

FOREIGN PATENT DOCUMENTS

| | | |
|---|---|---|
| FR | 1001834 | 3/1952 |
| FR | 1220131 | 5/1960 |
| WO | 0027273 | 3/2000 |

* cited by examiner

ICEMAKER ASSEMBLY

CROSS REFERENCE TO RELATED APPLICATIONS

Continuity Statement

This application claims priority of Provisional Applications entitled "Icemaker Assembly," by Tiemann, Voorhees & Shapiro, Ser. No. 60/158,629; Ser. No. 60/158,630; Ser. No. 60/158,631; Ser. No. 60/158,633; Ser. No. 60/158,634; and Ser. No. 60/158,636, each filed Oct. 8, 1999, which Provisional Applications are herein incorporated by reference.

BACKGROUND OF INVENTION

This invention relates generally to an automatic icemaker, and more specifically to an improved icemaker having a conveyor assembly.

A conventional automatic icemaker in a typical residential refrigerator has three major subsystems: an icemaker, a bucket with an auger and ice crusher, and a dispenser insert in the freezer door that allows the ice to be delivered to a cup without opening the door.

The icemaker is usually a metal mold that makes between six to ten ice cubes at a time. The mold is filled with water at one end and the water evenly fills the ice cube sections through weirs (shallow parts of the dividers between each cube section) that connect the sections. Opening a valve on the water supply line for a predetermined period of time usually controls the amount of water. The temperature in the freezer compartment is usually between about −10 F to about +10 F. The mold is cooled by conduction with the freezer air, and the rate of cooling is enhanced by convection of the freezer air, especially when the evaporator fan is operating. A temperature-sensing device in thermal contact with the ice cube mold generates temperature signals and a controller, monitoring the temperature signals indicates when the ice is ready to be removed from the mold. When the ice cubes are ready, a motor in the icemaker drives a rake in an angular motion. The rake pushes against the cubes to force them out of the mold. A heater on the bottom of the mold is turned on to melt the interface between the ice and the metal mold. When the interface is sufficiently melted, the rake is able to push the cubes out of the mold. Because the rake pivots on a central axis, the cross-sectional shape of the mold typically is an arc of a circle to allow the ice to be pushed out.

After the ice is harvested, a feeler arm, usually driven by the same motor as the rake, is raised from and lowered into the storage bucket. If the arm cannot reach its predetermined low travel set point, it is assumed that the ice bucket is full and the icemaker will not harvest until more ice has been removed from the bucket. If the feeler arm returns to its low travel set point, the ice making cycle repeats.

The ice storage bucket holds and transports ice to the dispenser in either crushed or whole cube form. If a user requests ice at the dispenser a motor drives an auger that pushes the ice to the front of the bucket where a crusher is located. The position of a door, controlled by a solenoid, determines whether or not the cubes will go through the crusher or by-pass it and be delivered as whole cubes. The crusher has sets of stationary and rotating blades that break the cubes as the blades pass each other. The crushed or whole cubes then drop into the dispenser chute.

The dispenser chute connects the interior of the freezer with the dispenser and usually has a door, activated by a solenoid, that opens when the user requests ice. The dispenser has switches that permit the user to select crushed or whole cubes, or water to be delivered to the glass. The dispenser may have a switch that senses the presence of a glass and starts the auger motor and opens the chute door.

Occasionally, the ice cubes that are stored in the storage bucket fuse together in large clusters of cubes. These fused clusters are much more difficult for the crusher to break up, raising the crushing design requirements for the mechanism and occasionally causing damage. Additionally, the designs of most conventional icemaker systems use substantial portions of the freezer volume, typically 25%-30%.

Accordingly, there is a need in the art for an improved icemaker assembly.

SUMMARY OF INVENTION

An icemaker assembly is disposed within a refrigerator having a freezer compartment, a fresh food compartment and respective freezer and fresh food door assemblies. The icemaker assembly comprises a conveyor assembly positioned within the freezer compartment having a flexible conveyor belt with a multiplicity of individual ice cube molds for creation of individual ice cubes. An ice cube storage bin is positioned below the conveyor assembly, for example in the freezer door, for storing the ice cubes and a fullness sensor is positioned for determining the fill level of ice cubes within the ice cube storage bin.

DETAILED DESCRIPTION

Figure 1:
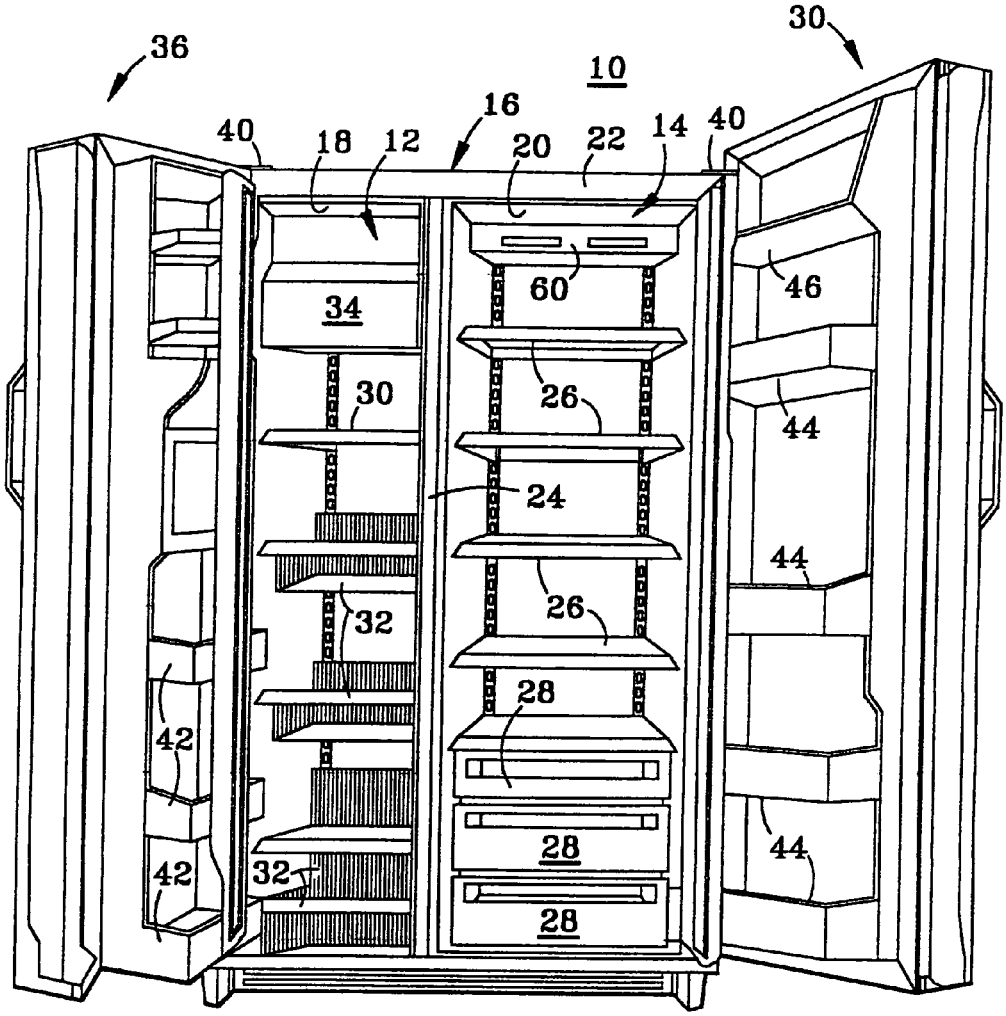
FIG. 1 PRIOR ART
FIG. 1 is a front perspective view of a side-by-side refrigerator with the access doors open.

FIG. 1 is a front perspective view of a side-by-side refrigerator 10 including a freezer compartment 12 and a fresh food compartment 14. Freezer compartment 12 and fresh food compartment 14 are arranged side-by-side. A side-by-side refrigerator such as refrigerator 10 is commercially available from General Electric Company, Appliance Park, Louisville, Ky. 40225.

Refrigerator 10 includes an outer case 16 and inner liners 18 and 20. The space between case 16 and liners 18 and 20, and between liners 18 and 20, is typically filled with foamed-in-place insulation. Outer case 16 normally is formed by folding a sheet of a suitable material, such as pre-painted steel, into an inverted U-shape to form the top and side walls of case 16. The bottom wall of case 16 normally is formed separately and attached to the sidewalls and to a bottom frame that provides support for refrigerator 10. Inner liners 18 and 20 are typically molded from a suitable plastic material to form freezer compartment 12 and fresh food compartment 14, respectively. Alternatively, liners 18 and 20 may be formed by bending and welding a sheet of a suitable metal, such as steel. The illustrative embodiment includes two separate liners 18 and 20 as it is a relatively large capacity unit and separate liners add strength and are easier to maintain within manufacturing tolerances. In smaller refrigerators, a single liner is formed and a mullion spans between opposite sides of the liner to divide it into freezer compartment 12 and fresh food compartment 14.

A breaker strip 22 extends between the case front flange and the outer front edges of liners 18 and 20. Breaker strip 22 is formed from a suitable resilient material, such as an extruded acrylo-butadiene-styrene based material (commonly referred to as ABS).

The insulation in the space between liners 18 and 20 is covered by another strip of resilient material 24, which is commonly referred to as the mullion. Mullion 24 is preferably formed of an extruded ABS material. It will be understood that in a refrigerator with a separate mullion dividing a unitary liner into a freezer and fresh food compartment, the front face member of that mullion corresponds to mullion 24. Breaker strip 22 and mullion 24 form a front face, and extend completely around the inner peripheral edges of case 16 and vertically between liners 18 and 20. Mullion 24, insulation between compartments 12 and 14, and the spaced wall of liners 18 and 20 separating compartments 12 and 14, sometimes are collectively referred to as the center mullion wall.

Shelves 26 and drawers 28 normally are provided in fresh food compartment 14 to support items being stored therein. Similarly, shelves 30 and wire baskets 32 or the like are provided in freezer compartment 12.

A freezer door 36 and a fresh food door 38 close the access openings to freezer and fresh food compartments 12 and 14, respectively. Each door 36, 38 is mounted by a top hinge 40 and a bottom hinge (not shown) to rotate about its outer vertical edge between an open position, as shown in FIG. 1, and a closed position closing the associated storage compartment. Freezer door 36 typically includes a plurality of storage shelves 42 and fresh food door 38 typically includes a plurality of storage shelves 44 and a butter storage bin 46.

Figure 2:
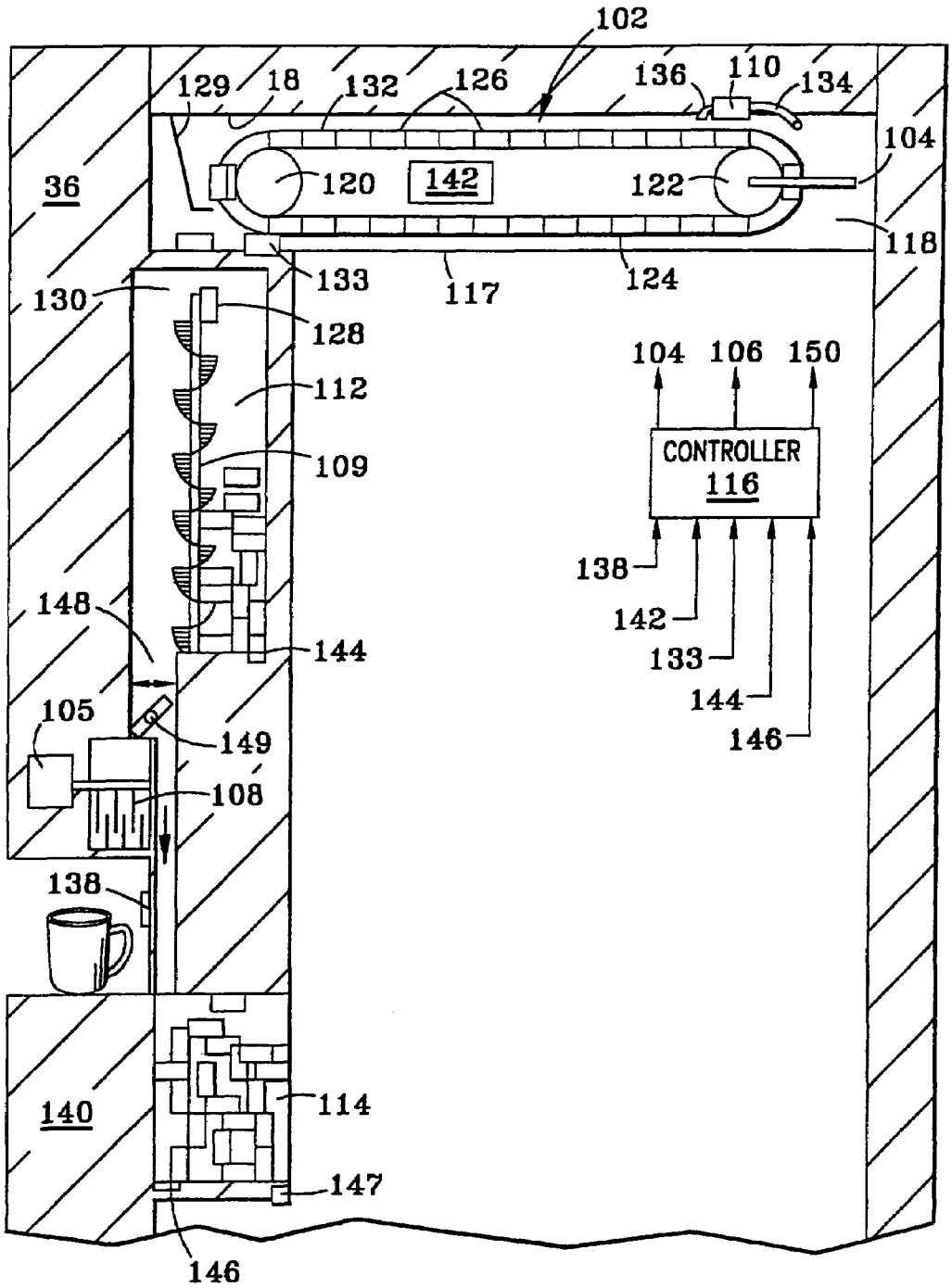
FIG. 2 is a part schematic side elevational view of a refrigerator including one embodiment of the instant invention.

In accordance with one embodiment of the instant invention, an icemaker assembly 100 is disposed within freezer compartment 12, as shown in FIG. 2.

Icemaker assembly 100 includes a conveyor assembly 102, a first motor 104 drivingly coupled to conveyor assembly 102, a second motor 106 drivingly coupled to an ice crusher 108 and an auger mechanism 109, a refill valve 110 positioned adjacent to conveyor assembly 102, a first ice cube storage bin 112, an optional second ice cube storage bin 114, and a controller 116 electrically coupled to first motor 104 and second motor 106.

Conveyor assembly 102 is positioned within freezer compartment 12, typically within a top portion 118 of freezer compartment 12, defined by freezer liner 18, freezer door 36 and a baffle 117. Conveyor assembly 102 comprises at least a front roller 120 and a rear roller 122 and a continuous flexible conveyor belt 124 fitted in tension about front and rear rollers 120, 122. In one embodiment, flexible conveyer belt 124 is made of a flexible polymer. In illustrative examples flexible conveyer belt 124 is made from a thermoplastic elastomer, butyl rubber, chlorobutyl rubber, natural rubber, synthetic rubber, neoprene rubber, polyurethane, ethylene-propylene-diene modified, ethylene-propylene rubber, silicone rubber or the like. Silicone rubber is particularly preferred.

A multiplicity of individual ice cube molds 126 are disposed within or upon conveyor belt 124 for creation of individual ice cubes 128 therein. Typically, ice cube molds 126 are molded directly into the material of flexible conveyor belt 124. In an alternative embodiment, ice cube molds 126 are made of a rigid material and are fixedly attached to conveyor belt 124. The rigid material can be, for example, polypropylene, polyethylene, nylon, ABS, or the like.

Figure 3:
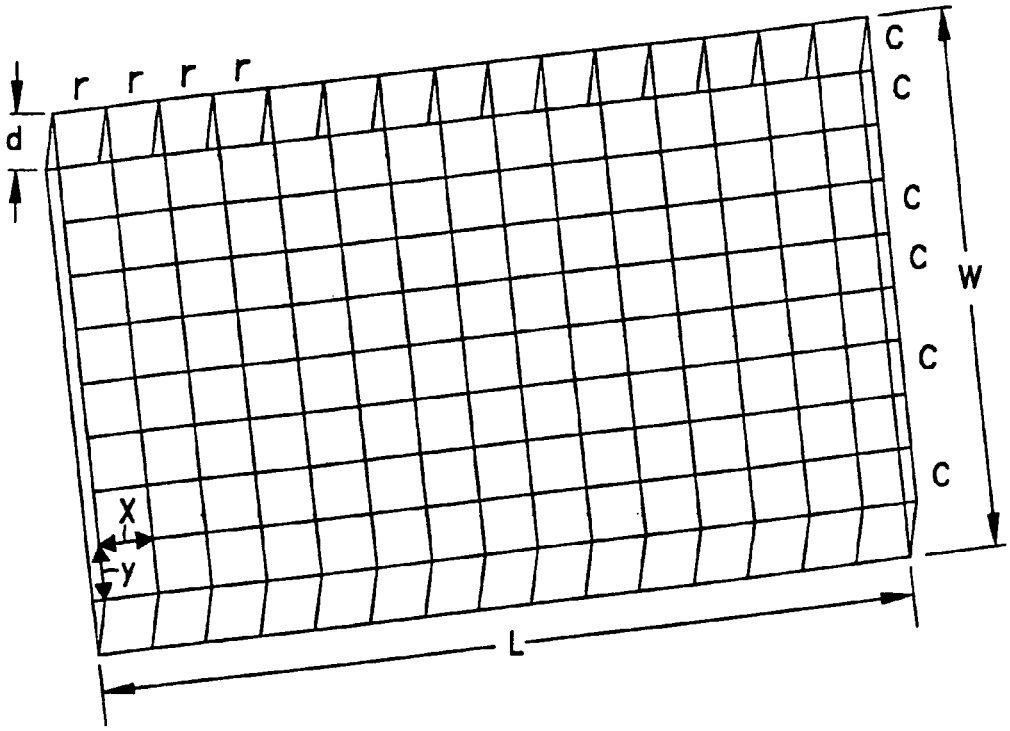
FIG. 3 is a part schematic side elevational view of one embodiment of a flexible conveyor belt in accordance with one embodiment of the instant invention.

Flexible conveyor belt 124 dimensions can vary depending upon the size of freezer compartment 12 and the desired ice cube 128 output for a respective freezer icemaker assembly 100. Typically, a nominal linear length (l) of flexible conveyor belt 124 is in the range between about 12 inches to about 18 inches, a nominal width (w) is in the range between about 3 inches to about 8 inches and a nominal depth (d) is in the range between about 0.5 inches to about 1.5 inches, as shown in FIG. 3.

As discussed above, the number of separate ice cube molds 126 is dependent upon the desired icemaking capacity, but a nominal number of individual ice cube molds 126 is in the range between about 20 to about 300 divided into a nominal number of rows (r) in the range between about 10 to about 30 and a nominal number of columns (c) in the range between about 2 to about 10. The dimensions of an individual ice cube mold 126 can vary depending on the size of ice cubes 128 desired but a nominal length (x) is in the range between about 0.75 inches to about 2 inches, and a nominal width (y) is in the range between about 0.5 inches to about 1.5 inches. Also, a variety of cube shapes can be used, including any conventional shapes as well as ornamental shapes such as fish, penguins, scallops, hemispheres, or the like.

First motor 104 (FIG. 2) is drivingly coupled to conveyor assembly 102. When energized, first motor 104 drives rear roller 122 (or alternatively front roller 120) causing conveyor belt 124 to rotate rear-to-front. A portion of ice cube molds 126 face generally upward during ice cube 128 formation. As conveyor belt 124 rotates forward over front roller 120, a portion of ice cube molds 126 face generally downward and ice cubes 128 frozen within are gravity fed into first ice cube storage bin 112. In one embodiment, first ice cube storage bin 112 is disposed within freezer door 36. First ice cube storage bin 112 can be molded directly into freezer door assembly 36 or first ice cube storage bin 112 can be fixedly attached to or removeably disposed within a portion of freezer door assembly 36. A harvester bar 129 is positioned adjacent to front roller 120 so as to contact a portion of each respective ice cube 128 (as ice cube molds 126 rotate forward over front roller 120) and assist ice cubes 128 to eject from ice cube molds 126.

As shown best in FIG. 2, the position of front roller 120 is aligned with a top portion 130 of first ice cube storage bin 112 (when freezer door 36 is in a closed position) such that ice cubes 128 frozen within conveyor belt 124 are gravity fed into first ice cube storage bin 112 as conveyor belt 124 rotates forward over front roller 120.

Refill valve 110 is positioned within freezer compartment 12 generally positioned above at least one and typically a row 132 of ice cube molds 126. Refill Valve 110 is actuated when a belt position sensor 133 (optical, mechanical, proximity switch or the like) generates a signal to controller 116 indicating that belt 124 is in the correct position for refill. In one embodiment, belt position sensor 133 detects holes that are punched though a band that extends from the bottom web of conveyor belt 124 past a sidewall of a respective ice cube mold 126. An IR LED positioned adjacent, typically above, the band emits light that reaches a photodiode positioned below the band only when a hole passes between the two optical devices. An electronic circuit determines whether the hole is present by processing the signal from the photodiode. If the hole is between the LED and the photodiode, the circuitry stops first motor 104 and commences a water dose.

Typically, refill valve 110 is positioned within a machine or mechanical compartment (not shown). An outlet tubing 134 from refill valve 110 enters freezer compartment 12 from a rear wall of the liner 18. A fill tube 136 connected to outlet tube 134 delivers water to a respective row 132 of ice cube molds 126 at a portion of belt 124, typically adjacent to rear roller 122.

Figure 4:
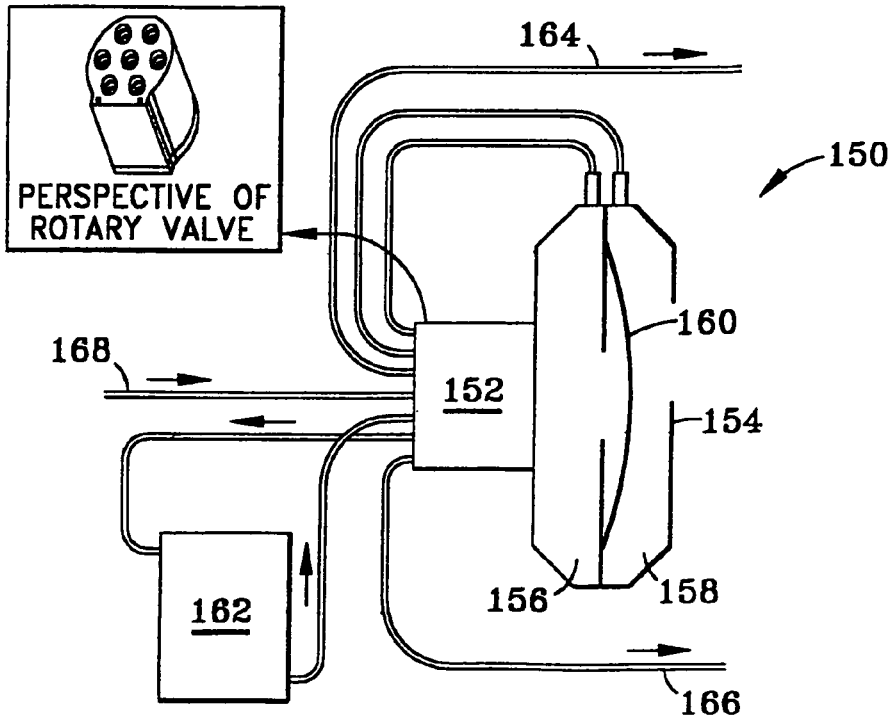
FIG. 4 is a part schematic view of another aspect of the instant invention.

In one embodiment, refill valve 110 is a doser mechanism 150 consisting of a rotary multiport valve 152 and a doser housing 154, as shown in FIG. 4. Doser housing 154 consists of an enclosed volume of about 10-50 ml divided into a first section 156 and a second section 158 by a flexible diaphragm 160. Tubing to rotary valve 152 connects ports on each section 156, 158 of doser housing 154. Tubing to the inlet also connects rotary valve 152 and outlet ports of a water filter 162, an icemaker fill tube 164, a water dispenser tube 166 and a water supply 168.

During a fill cycle, valve 152 simultaneously connects the port from water supply 168 (or alternatively water filter 162 outlet, if used) to first section 156 of doser housing 154, and ice maker fill tube 164 to second section 158 of doser housing 154. The pressure of water supply 168 pushes flexible diaphragm 160 displacing the water in second section 158 of doser housing 154 to fill tube 164. After an appropriate amount of time for diaphragm 160 to fully transverse second section 158, rotary valve 152 is moved to connect water supply 168 (or alternatively water filter 162 outlet) to second section 158 of doser housing 154, and simultaneously connect first section 156 of doser housing 154 with icemaker fill tube 164. Water supply 168 pressure forces diaphragm 160 back across doser housing 154 displacing the water in first section 156 of doser housing 154 to fill tube 164. Finally rotary valve 152 is moved to isolate water supply 168 from the system.

Second motor 106 (FIG. 2) is positioned within freezer door 36 and is drivingly coupled to ice crusher 108, which ice crusher 108 either crushes ice cubes 128 or delivers whole ice cubes 128 depending on the user selection. An end user by means of a push button 138, or similar actuation device selectively controls second motor 106.

Second ice cube storage bin 114 is typically removably disposed within freezer door 36. Second ice cube storage bin 114 is typically an optional supplemental storage bin as first ice cube storage bin 112 is the primary ice storage bin. Second ice cube storage bin 114 is typically disposed in a lower portion 140 of freezer door 36, below first ice cube storage bin 112 and below ice crusher 108.

Second ice cube storage bin 114 is typically removable and as such, when removed, its space within door 36 can be used for storing other items. To prevent the ice maker assembly 100 from sending ice cubes 128 to second ice cube storage bin 114 when second ice cube storage bin 114 is not in place, a detection sensor 147 is used. In one embodiment, detection sensor 147 is a microswitch that is actuated by a special geometrical feature of second ice cube storage bin 114, such as a pin or a tab. Alternatively, detection sensor 147 could be an inductive proximity sensor that detects a metal insert on second ice cube storage bin 114, or an optical sensor that detects a reflecting surface adhered to second ice cube storage bin 114, or the like.

First motor 104 is energized when the fullness of ice cubes 128 in first ice cube storage bin 112 falls below a preset fill level and an ice-ready sensor 142 generates a signal to controller 116 that a respective row 132 of ice cubes 128 to be delivered is frozen. If a first fullness sensor 144 disposed within or about first ice cube storage bin 112 generates a signal to controller 116 that the level of ice cubes 128 within first ice cube storage bin 112 has dropped below a preset fill level, a cycle is initiated and first motor 104 advances conveyor belt 124 one full row 132 of ice cube molds 126 and refill valve 110 delivers water to a row of empty molds 126.

In one embodiment, ice-ready sensor 142 is a temperature sensor such as a thermistor or a thermocouple in sliding contact with belt 124 adjacent front roller 120 where ice cubes 128 are delivered. Depending on the design of belt 124 and the airflow of refrigerator 10 various algorithms can be used to determine ice readiness from a temperature sensor. Time and temperature can be integrated to provide a degree-minute set point beyond which it is known that the ice is frozen. Alternatively a temperature cutoff can be used below which it is known that the ice is frozen. This temperature cutoff will typically be about 15° F.

Another ice-ready sensor 142 is based on capacitance. The capacitance sensor is positioned below belt 124 near front roller 120. The sensor is part of a capacitance bridge circuit. An excitation frequency is applied to the bridge. The bridge is balanced such that when a respective ice cube mold 126 is empty the voltage across the bridge is nearly zero. When water is in a respective ice cube mold 126, the capacitance reading of ice-ready sensor 142 increases dramatically, because the dielectric constant of water is about 80 times that of air, causing the bridge to become unbalanced. Thus the voltage signal sensed by controller 116 increases dramatically when water is in a respective ice cube mold 126. As the water freezes, the dielectric constant decreases to about 6 times that of air, reducing the imbalance of the bridge and decreasing the signal sent by ice-ready sensor 142 to controller 116. Alternatively, the bridge can be balanced such that the output is nearly zero when water is present in the mold, in which case the bridge becomes more unbalanced when the water freezes, and a large output indicates that the ice is ready.

If a second fullness sensor 146 disposed within or about second ice cube storage bin 114 generates a signal to controller 116 that the level of ice cubes 128 within second ice cube storage bin 114 has dropped below a preset fill level, a cycle is initiated and controller 116 energizes second motor 106 to rotate auger mechanism 109 disposed within first ice cube storage bin 112. Auger mechanism 109 advances ice cubes 128 into an ice chute 148. Controller generates a signal to switch a diverter 149 to block ice chute from delivering ice cubes 128 to the dispenser and to allow passage of ice cubes 128 to second ice cube storage bin 114 and ice cubes 128 are delivered to second ice cube storage bin 114.

In one embodiment, fullness sensors 144, 146 are a weight determining means such as a microswitch. In another embodiment, fullness sensors 144, 146 are an ultrasonic level detector.

Figure 5:
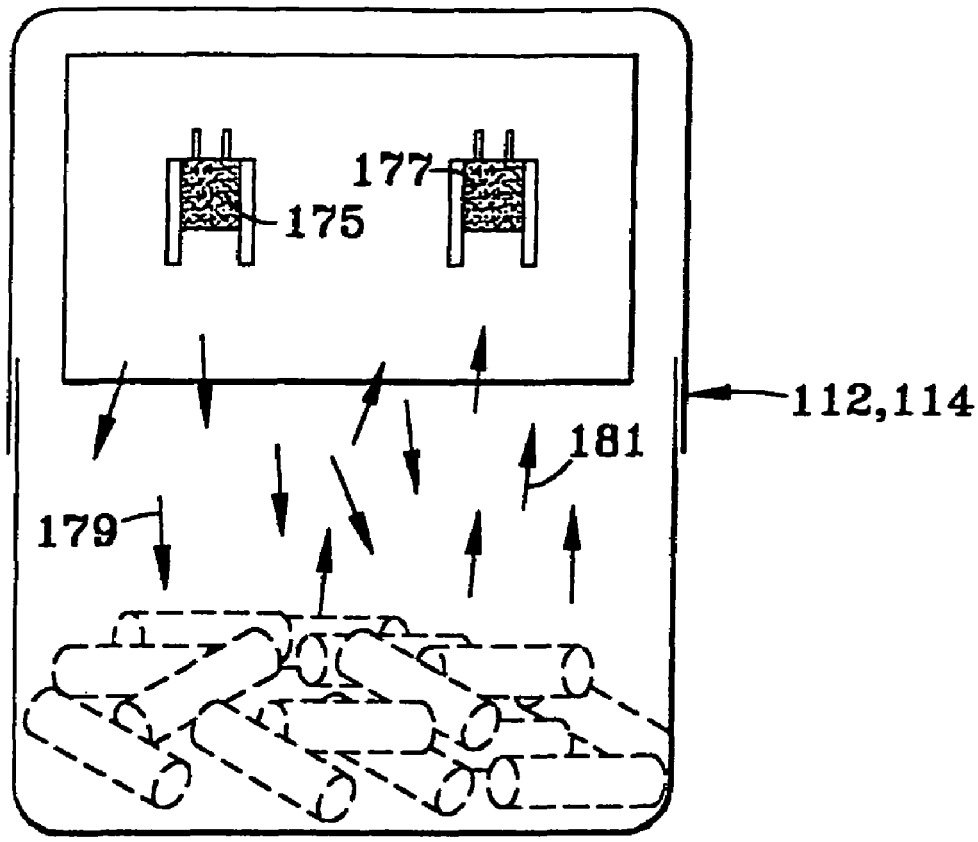
FIG. 5 is a part schematic view of another aspect of the instant invention.

In a preferred embodiment, fullness sensors 144, 146 comprise an ultrasonic transmitter (piezo driver) 175, an ultrasonic receiver (piezo microphone) 177 and an electronic circuit capable of causing transmitter to emit a short burst 179 (approximately 100 microseconds long) of ultrasound and capable of measuring the time interval between short burst 179 and a return echo 181 received by receiver 177, as shown in FIG. 5. This time interval is proportional to the distance between fullness sensor 144, 146 and the top layer of ice cubes 128 and is therefore a measure of the fullness of ice cube storage bin 112, 114.

In another embodiment, fullness sensors 144, 146 comprise an optical proximity switch that detects the fullness of ice cube storage bin 112, 114. The optical switch sends out light (usually IR) and detects the reflected light intensity with a photodiode. High intensity of reflected light indicates close proximity of ice or fullness. Pulse width modulation of the IR signal can be used to increase the sensitivity of the optical switch.

The instant invention does not use solenoid valves and has no "feeler" to determine if ice cube storage bins 112, 114 (FIG. 2) are full, thereby avoiding the two most frequent causes of service calls. Additionally, since ice cubes 128 are not partially melted for mold release and stored in buckets that are protected from defrost air, fusing of ice cubes 128 is less likely to occur.

In operation, if a system user presses push button 138, a signal is generated and controller 116 energizes second motor 106 and ice cubes 128 are delivered by auger mechanism 109 from first ice cube storage bin 112 to a conventional ice dispenser. As with most conventional delivery systems, a system user can select either crushed ice or whole cubes to be delivered (or water in most systems). If a user selects crushed ice, ice cubes 128 are fed from first ice cube storage bin 112 to crusher 108. Second motor 106 activates crusher 108 and sets of rotating and stationary blades break up the cubes as the blades pass each other, and the crushed ice is delivered to the system user. If a user selects whole ice cubes, crusher 108 is bypassed and whole ice cubes 128 are delivered to the system user.

Figure 6:
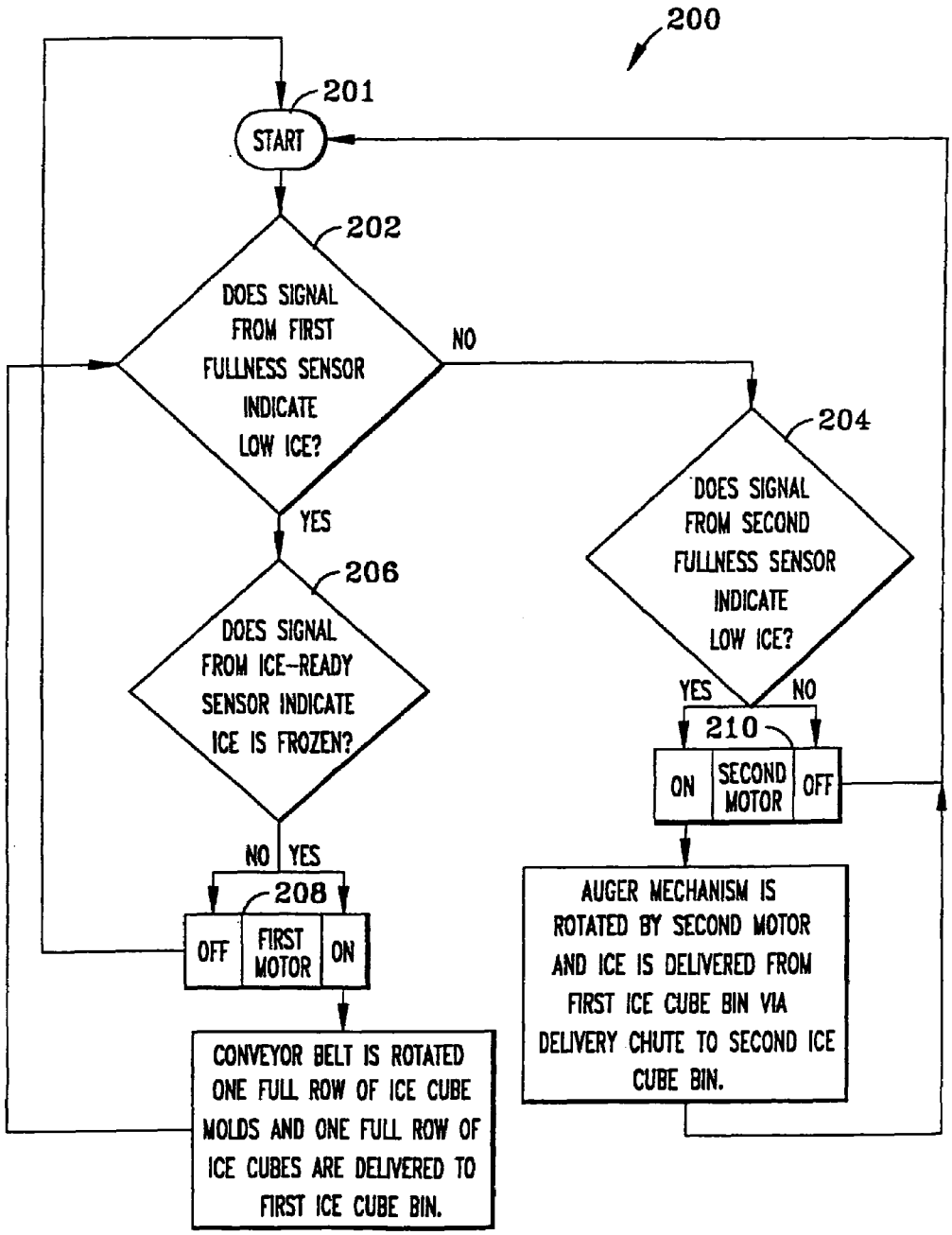
FIG. 6 is a flow chart showing one control scheme in accordance with one embodiment of the instant invention.

An exemplary control logic sequence 200 (starting at block 201) for icemaker assembly 100 is shown in FIG. 6. This control logic sequence is inputted into controller 116 (FIG. 2), for example, by programming into memory of an application specific integrated circuit (ASIC) or other programmable memory device.

At block 202 (FIG. 6), controller 116 monitors signals generated from first fullness sensor 144. Controller 116 compares the signals generated from first fullness sensor 144 with a preset fullness value.

If the signals generated from first fullness sensor 144 are greater than or equal to the preset fullness value, the control sequence advances to block 204. If, however, the signals generated from first fullness sensor 144 are less than the preset value (indicating low ice), the control sequence advances to block 206.

At block 206, controller 116 monitors signals generated from ice-ready sensor 142. Controller 116 compares the signals generated from ice-ready sensor 142 with a preset sensor value.

If the signals generated from ice-ready sensor 142 are outside the preset range, ice cubes 128 are not frozen. The control sequence advances to block 208 and first motor 104 remains off, or if previously on, first motor 104 is turned off and the control sequence returns to starting block 201.

If, however, the signals generated from ice-ready sensor 142 are greater than or equal to the preset value, ice cubes 128 are frozen. The control sequence advances to block 208 and first motor 104 is turned on. When first motor 104 is energized, conveyor belt 124 is rotated one full row 132 of ice cube molds 126 and one full row 132 of ice cubes 128 are delivered to first ice cube bin 112. The control sequence then returns to block 201 and the sequence is initiated again.

At block 204, controller 116 monitors signals generated from second fullness sensor 146. Controller 116 compares the signals generated from second fullness sensor 146 with a preset sensor value.

If the signals generated from second fullness sensor 146 are lower than the preset value (indicating low ice), the control sequence advances to block 210 and second motor 106 is turned on. When second motor 106 is energized, auger mechanism 109 is rotated and ice cubes 128 are delivered from first ice cube storage bin 112 via delivery chute 148 to second ice cube storage bin 114. The control sequence then returns to block 201 and the sequence is initiated again.

If, however, the signals generated from second fullness sensor 146 are greater than or equal to the preset value, the control sequence advances to block 210 and second motor 106 remains off or if previously on, second motor 106 is turned off and the control sequence returns to block 201.

Figure 7:
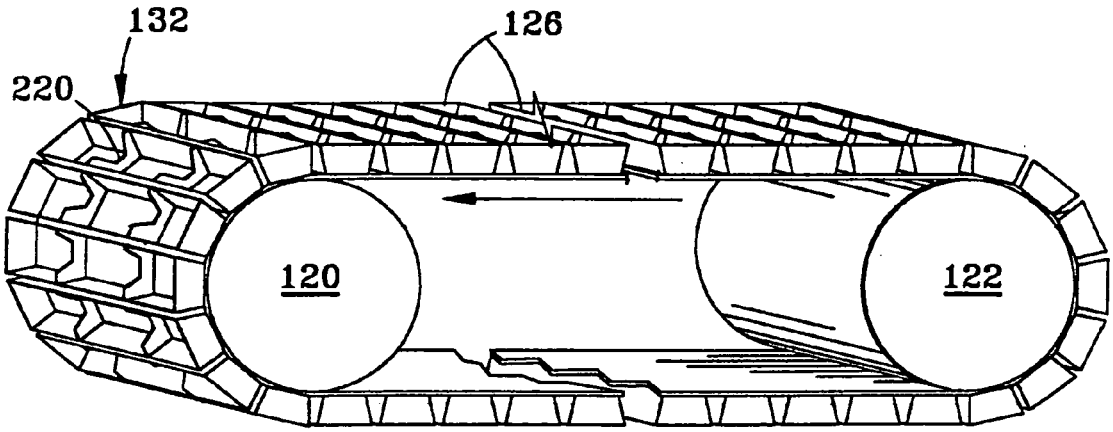
FIG. 7 is a part schematic view of another aspect of the instant invention.
Figure 8:
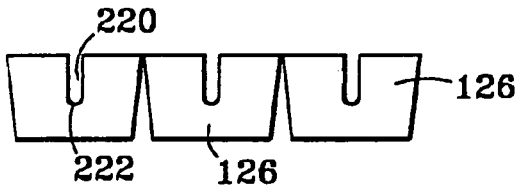
FIG. 8 is a part schematic view of another aspect of the instant invention.

Ice cube molds 126 disposed within conveyor belt 124 must stretch by a large factor as molds 126 travel over each roller 120, 122. Accordingly, in one embodiment, each ice cube mold 126 within a single row 132 of flexible conveyor belt 124 is connected to the adjacent ice cube molds with deep, narrow weirs 220, as shown in FIGS. 7 and 8. Since weirs 220 can open up without excessively stretching the mold material, as flexible conveyor belt 124 travels over each roller 120, 122, (FIG. 2) deep, narrow weirs 220 substantially increase the compliance of flexible conveyor belt 124 and reduce the amount of stretching required. A side view of deep, narrow weirs 220 is shown in FIG. 8. For an ice cube 128 roughly one inch on each side, weir 220 is typically in the range between about 0.3 inches to about 0.75 inches deep by about 0.06 inches to about 0.25 inches wide. To prevent regions of concentrated stress, bottom 222 of weir 220 is preferably a semi-circle.

Figure 9:
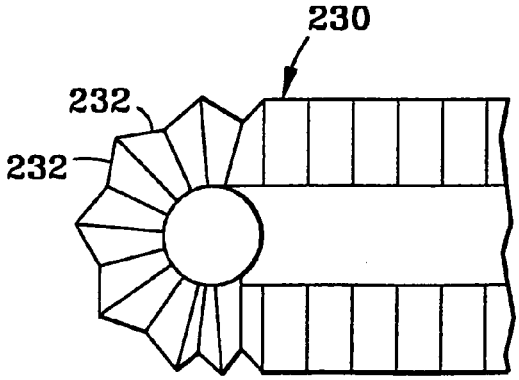
FIG. 9 is a part schematic view of another aspect of the instant invention.
Figure 10:
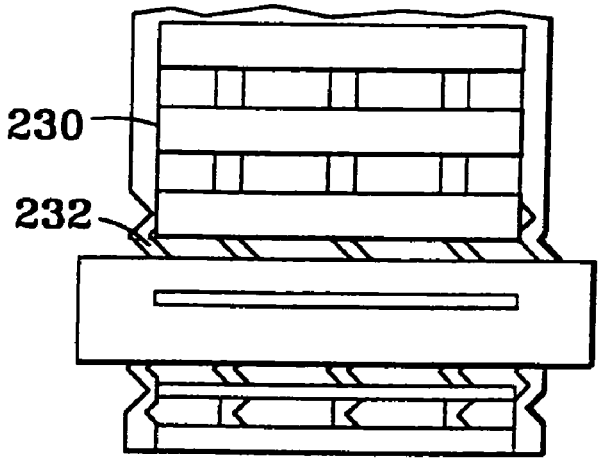
FIG. 10 is a part schematic view of another aspect of the instant invention.

One embodiment of ice cube molds 126 with fanfold walls 230 is shown in FIGS. 9 & 10. When ice cube molds 126 are made from highly elastic materials (such as silicone rubber) as molds 126 are deformed, after passing front roller 120, in order to release frozen ice cubes 128, molds 126 tend to bend inward on an opposite side in response to being bent outward on a pair of sides. This bending causes ice cubes 128 to be gripped instead of released.

Accordingly, in this embodiment the material comprising walls 230 is cast with alternating blades 232 coming in from both sides so that the path of continuous material follows a serpentine path in the direction that mold walls 230 are to be stretched. Depending on the amount of stretch desired, the thickness of blades 232 can be varied. Wider blades 232, in smaller numbers, will result in a greater fraction of the path being transverse to the direction of stretch, and therefore accommodating less stretch. A larger number of blades will result in the majority of the path being transverse to the direction of the stretch, so there is more material that can straighten out. In the case of conveyor belt 124, the requirement of stretching arises from the need to go around rollers 120, 122, the amount of stretch required at the top of molds 126 is greater than what is needed at the bottom. This permits an economical design in which the depth of the zigzag varies linearly from top to bottom.

Figure 11:
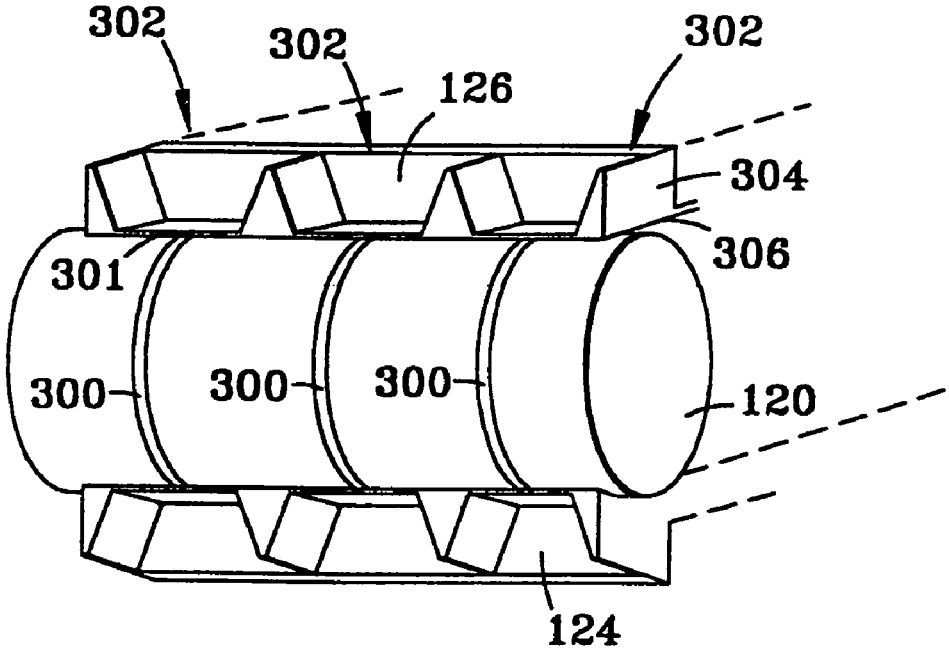
FIG. 11 is a part schematic view of another aspect of the instant invention.

Occasionally, ice cubes 128 cling to the molds and lend rigidity to molds 126 resulting in ice cubes 128 (FIG. 2) not being released. In accordance with another embodiment of the instant invention, circumferential ridges 300 are formed on front roller 120 located under the centers 301 of each column 302 of ice cubes 128 where ice cubes 128 are to be ejected, as shown in FIG. 11. While centers 301 of ice cube molds 126 are passing over ridges 300, sides 304 of molds are constrained to roll at the smaller radius between ridges 300. As a result, centers 301 of mold 126 are deflected with respect to sides 304 and ice cubes 128 (FIG. 2) are ejected.

Ice cubes 128 tend to stick tightly to most materials, and in their hard-frozen state, they lend substantial rigidity to any mold they may be frozen to. This may make it difficult to eject ice cubes 128 in a hard-frozen state. Ice cubes in automatic icemakers are usually melted by a heating element so as to produce a thin film of liquid water between the ice cubes and the molds. This film makes it easy to dislodge the ice cubes from the molds.

In this embodiment, bases 306 of ice cube molds 126 are affixed to the conveyor belt 124 on rectangular regions that are rigid and planar in the regions where sides 304 of molds 126 contact belt 124, and that are somewhat flexible in the region of center 301 of mold 126. The regions of belt 124 between these rectangular regions are flexible. The molds are not connected to belt 124 at any other place except bases 306. Thus, when rows 302 of molds 126 pass around front roller 120, a generally wedged shape region opens up between adjacent rows due to the fact that the tops of the molds are at a larger radius with respect to the roller shaft than the bases. Due to the rigidity and the planarity of the regions where sides 304 of the bases are attached to belt 124 and the flexibility of belt 124 between these regions, base regions 306 in adjacent rows will naturally want to follow a polygonal shape rather than a circle, and in a preferred embodiment, such a shape is formed into the roller in the regions where the bases are rigid and the belt tension is adjusted to assure a tight fit between the polygon shape of the belt and that in the roller.

In this same embodiment, the region of the roller that contacts the central region of the molds is left in its original cylindrical form. In this embodiment, there are circumferential ridges 300 disposed on roller 120 in the regions beneath centers 301 of molds 126. In both embodiments, the roller regions beneath centers 301 of molds 126 have a larger radius than the radius at which mold 301 centers would travel in an unstrained condition, and they must deform in order to travel around the roller. This deformation will break the bond between ice cubes 128 and mold 126 and eject the ice cubes 128.

It should be noted that in order to fracture the bond between the ice cube and its mold, shear must be propagated all the way up the sides of the mold. This will happen if the sides of the mold are sufficiently rigid, but if they are too flexible the deformation induced at the base may not propagate all the way to the top. In this case a stiffener can be incorporated either within the sides of the molds or along an outside surface. In one embodiment (not shown) external stiffeners are used which also serve to stiffen the edges of the bases of the molds (as discussed above).

Figure 12:
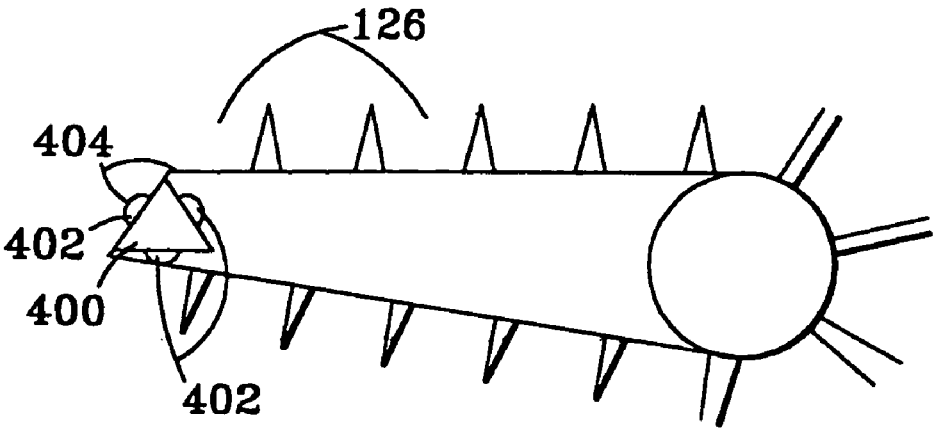
FIG. 12 is a part schematic view of another aspect of the instant invention.

A side view diagram of another roller shape is shown in FIG. 12. Here a preferred triangular roller shape 400 is shown. Note that each side of triangle 400 is shown with a bump 402 in the middle of it. This is actually a row of bumps whose positions correspond to the centers of ice cube molds 126 in the row. Ice cube molds 126 molds have at least a flexible portion 404 corresponding to the places where bumps 402 contact them so that bumps 402 can protrude into molds 126 and eject ice cubes 128 therefrom. As a row of molds 126 advances to the front, bumps 402 first contact molds 126 during the cycle that advances the row to a position where the bases are vertical FIG. 12 is shown with a circular roller on the right (rear roller). The advantage of a circular roller is that the diameter can be varied continuously to exactly achieve a desired rate of motion of the belt. Regular polygons of any desired number of sides could also have been used, and each of these would provide a specific rate of motion.

Figure 13:
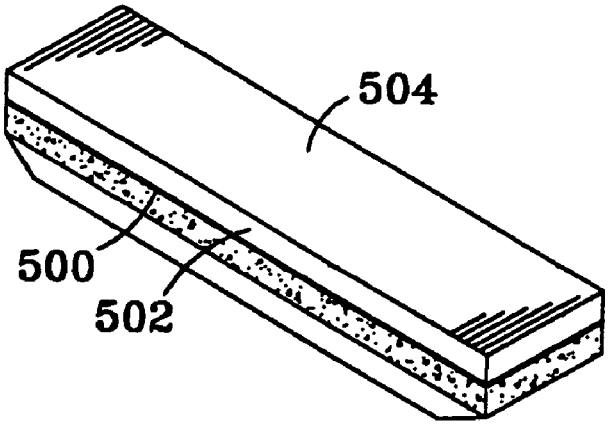
FIG. 13 is a part schematic view of another aspect of the instant invention.

Belt can be made of more than one material. For example, an inelastic material can be used as a bottom web 500, which is bonded to elastic material that forms a lateral web 502 and a longitudinal vertical 504 web that form the sides of the ice cubes, as shown in FIG. 13. An advantage of a composite construction such as this is that inelastic bottom web 500 may be stronger with regards to roller-belt friction and may provide longer life for belt 124.

While the invention has been described with reference to preferred embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiments disclosed herein, but that the invention will include all embodiments falling within the scope of the appended claims.

The invention claimed is:

1. An icemaker assembly disposed within a freezer assembly, said icemaker assembly comprising a conveyor assembly positioned within a freezer compartment of said freezer assembly, having at least a front roller and a rear roller and a continuous flexible conveyor belt fitted in tension about said front and rear rollers, said conveyor belt having a multiplicity of individual ice cube molds for creation of individual cubes therein; and at least one ice cube storage bin positioned below said conveyor assembly for storage of said ice cubes;

wherein said flexible conveyor belt includes fanfold wells having alternating blades such that a path of continuous material follows a serpentine path in the direction that said ice cube molds are to be stretched.

2. An icemaker assembly in accordance with claim 1 wherein said freezer assembly is a refrigerator having a freezer compartment and a fresh food compartment.

3. An icemaker assembly in accordance with claim 1 wherein said refrigerator is a side-by-side refrigerator.

4. An icemaker assembly in accordance with claim 1, wherein said continuous flexible conveyor belt is made from the group consisting of thermoplastic elastomer, butyl rubber, chlorobutyl rubber, natural rubber, synthetic rubber, neoprene rubber, polyurethane, ethylene-propylene-diene modified, ethylene-propylene rubber, and silicone rubber.

5. An icemaker assembly in accordance with claim 1, wherein said continuous flexible conveyor belt has a length in the range between about 12 in. to about 18 in.

6. An icemaker assembly in accordance with claim 1, wherein said continuous flexible conveyor belt has a width in the range between about 3 in. to about 8 in.

7. An icemaker assembly in accordance with claim 1, wherein said continuous flexible conveyor belt has between about 20 individual ice cube molds to about 300 individual ice cube molds.

8. An icemaker assembly in accordance with claim 1, wherein said continuous flexible conveyor belt has between about 10 individual rows of ice cube molds and about 30 individual rows of ice cube molds.

9. An icemaker assembly in accordance with claim 1, wherein said ice cube molds are made of a rigid material and are attached to said flexible conveyor belt.

10. An icemaker assembly in accordance with claim 1, wherein said rigid material is selected from the group consisting of polypropylene, polyethylene, nylon, and ABS.

11. An icemaker assembly in accordance with claim 1 wherein said continuous flexible conveyor belt has between about 2 individual columns of ice cube molds and about 10 individual columns of ice cube molds.

12. An icemaker assembly in accordance with claim 1 further comprising a first motor drivingly coupled to at least one of said front or rear rollers, wherein said first motor is selectively energizable to drive said rollers and rotate said belt.

13. An icemaker assembly in accordance with claim 1 wherein the fullness of said ice cubes in said ice cube storage bin is detected by a fullness sensor.

14. An icemaker assembly in accordance with claim 13 wherein said fullness sensor is a weight determining means.

15. An icemaker assembly in accordance with claim 14 wherein said weight determining means is a microswitch.

16. An icemaker assembly in accordance with claim 13 wherein said fullness sensor is an ultrasonic level detector.

17. An icemaker assembly in accordance with claim 1 wherein each ice cube mold within a single row of flexible conveyor belt is connected to each adjacent ice cube molds with a deep-narrow weir.

18. An icemaker assembly in accordance with claim 1 further comprising a harvester bar disposed adjacent said front roller for harvesting ice cubes from said ice cube molds as said molds advance over said front roller.

19. An icemaker assembly in accordance with claim 1 further comprising a refill valve disposed within said freezer compartment and positioned above at least one of said ice cube molds.

20. An icemaker assembly in accordance with claim 1 further comprising a second motor positioned within said freezer door that is drivingly coupled to an ice crusher, which ice crusher either selectively crushes ice cubes or delivers whole ice cubes.

21. An icemaker assembly in accordance with claim 20, wherein said second motor is energized via an actuation device.

22. An icemaker assembly in accordance with claim 1 wherein said at least one ice cube storage bin is positioned within a freezer door of said freezer compartment.

23. An icemaker assembly in accordance with claim 22 herein said storage bin is a molded plastic bin permanently disposed within said freezer door.

24. An icemaker assembly in accordance with claim 22 wherein said storage bin is a party ice container removably disposed within said freezer door.

25. An ice cube conveyor assembly in accordance with claim 1 wherein said ice cube conveyor assembly is positioned in a top portion of said freezer compartment.

26. An ice cube conveyor assembly in accordance with claim 25 wherein said ice cube conveyor assembly is disposed within a conveyor housing.

* * * * *